US009784143B2

(12) United States Patent
Snyder et al.

(10) Patent No.: US 9,784,143 B2
(45) Date of Patent: Oct. 10, 2017

(54) MID LOCK DIRECTIONAL SUPPLY AND CAM TORSIONAL RECIRCULATION

(71) Applicant: HILITE GERMANY GMBH, Marktheidenfeld (DE)

(72) Inventors: John Snyder, Irving, TX (US); Steve Nance, Highland Village, TX (US); Udo Diederichs, Nurtingen (DE); Melissa Koenig, Ann Arbor, MI (US); Daniel Stanhope, Nunica, MI (US); Kenneth J. Parker, Clarkston, MI (US); Guenther Benischek, Illingen (DE)

(73) Assignee: HILITE GERMANY GMBH (DE)

( * ) Notice: Subject to any disclaimer, the term of this patent is extended or adjusted under 35 U.S.C. 154(b) by 103 days.

(21) Appl. No.: 14/743,599

(22) Filed: Jun. 18, 2015

(65) Prior Publication Data

US 2016/0010515 A1 Jan. 14, 2016

Related U.S. Application Data

(60) Provisional application No. 62/022,963, filed on Jul. 10, 2014.

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01); *F01L 2001/34456* (2013.01); *F01L 2001/34463* (2013.01); *F01L 2001/34469* (2013.01)

(58) Field of Classification Search
CPC ..... F01L 1/3442; F01L 2001/34463
USPC ..... 123/90.17
See application file for complete search history.

(56) References Cited

U.S. PATENT DOCUMENTS

| | | | |
|---|---|---|---|
| 5,497,738 | A | 3/1996 | Siemon et al. |
| 5,901,674 | A | 5/1999 | Fujiwaki |
| 6,173,687 | B1 | 1/2001 | Fukuhara et al. |
| 6,263,846 | B1 | 7/2001 | Simpson et al. |
| 6,378,475 | B2 | 4/2002 | Takenaka et al. |
| 6,386,164 | B1 | 5/2002 | Mikame et al. |
| 6,439,184 | B1 | 8/2002 | Takenaka et al. |
| 6,443,112 | B1 | 9/2002 | Kinugawa |

(Continued)

FOREIGN PATENT DOCUMENTS

| | | |
|---|---|---|
| EP | 2 282 020 | 2/2011 |
| EP | 2 412 944 | 2/2012 |

(Continued)

*Primary Examiner* — Phutthiwat Wongwian
*Assistant Examiner* — Loren Edwards
(74) *Attorney, Agent, or Firm* — Clark Hill PLC; James R. Foley

(57) ABSTRACT

A valve timing control device, in effect a cam phaser, for an internal combustion engine. The valve timing control device includes a rotor connected to a camshaft and having a plurality of vanes. A stator is engaged with the rotor, and includes a plurality of webs. Pressure chambers are provided between each of the webs and vanes. The cam phaser is configured to automatically locate to its mid-lock position, without having to rely on electronic control. At least one embodiment of the present invention is configured to use cam torque to recirculate oil from one side of the vanes of the rotor to the other.

15 Claims, 16 Drawing Sheets

(56) References Cited

U.S. PATENT DOCUMENTS

| | | | | |
|---|---|---|---|---|
| 6,460,496 | B2 | 10/2002 | Fukuhara et al. | |
| 6,477,996 | B2 | 11/2002 | Ogawa | |
| 6,481,402 | B1 | 11/2002 | Simpson et al. | |
| 6,666,181 | B2 * | 12/2003 | Smith | F01L 1/34 123/90.15 |
| 6,668,778 | B1 | 12/2003 | Smith | |
| 6,684,835 | B2 | 2/2004 | Komazawa et al. | |
| 6,742,484 | B2 | 6/2004 | Sluka et al. | |
| 6,779,499 | B2 | 8/2004 | Takenaka et al. | |
| 6,779,500 | B2 | 8/2004 | Kanada et al. | |
| 6,820,578 | B2 | 11/2004 | Kanada et al. | |
| 6,880,505 | B2 | 4/2005 | Kinugawa et al. | |
| 6,883,481 | B2 | 4/2005 | Gardner et al. | |
| 6,945,205 | B2 | 9/2005 | Heintzen et al. | |
| 6,968,818 | B2 | 11/2005 | Plank et al. | |
| 6,976,460 | B2 | 12/2005 | Komazawa et al. | |
| 7,290,510 | B2 | 11/2007 | Takahashi et al. | |
| 7,931,000 | B2 | 4/2011 | Ushida et al. | |
| 8,033,257 | B2 | 10/2011 | Fischer | |
| 8,356,583 | B2 * | 1/2013 | Smith | F01L 1/3442 123/90.15 |
| 8,973,542 | B2 | 3/2015 | Morehead et al. | |
| 2010/0186710 | A1 | 7/2010 | Persson et al. | |
| 2010/0199937 | A1 | 8/2010 | Fujiyoshi | |
| 2010/0204900 | A1 | 8/2010 | Gelez et al. | |
| 2010/0300388 | A1 | 12/2010 | Lang et al. | |
| 2010/0313835 | A1 | 12/2010 | Yamaguchi et al. | |
| 2011/0017156 | A1 | 1/2011 | Smith | |
| 2011/0035134 | A1 | 2/2011 | Urushihata | |
| 2011/0168111 | A1 | 7/2011 | Cowgill | |
| 2011/0232594 | A1 | 9/2011 | Miyachi et al. | |
| 2011/0315104 | A1 | 12/2011 | Imamura et al. | |
| 2012/0000437 | A1 | 1/2012 | Ozawa et al. | |

FOREIGN PATENT DOCUMENTS

| | | |
|---|---|---|
| JP | 2009-250073 | 10/2009 |
| JP | 2010-209780 | 9/2010 |
| JP | 2010-242531 | 10/2010 |
| JP | 2011-069287 | 4/2011 |
| JP | 2011-117317 | 6/2011 |
| JP | 2011-163270 | 8/2011 |
| JP | 2013-155612 | 8/2013 |
| WO | 2010/061936 | 6/2010 |
| WO | 2010/119322 | 10/2010 |
| WO | 2011/001702 | 1/2011 |

* cited by examiner

MID LOCK DIRECTIONAL SUPPLY AND CAM TORSIONAL RECIRCULATION

BACKGROUND OF THE INVENTION

An embodiment of the present invention relates to a valve timing control device or cam phaser of an internal combustion engine, wherein the cam phaser is configured to automatically locate to its mid-lock position, without having to rely on electronic control.

At least one embodiment of the present invention also relates to a cam phaser which is configured to use cam torque to recirculate oil to assist the oil pressure in locating the rotor to its mid-lock position.

A typical internal combustion engine provides that a crankshaft drives a drive wheel using a chain or drive belt. A stator is joined in a torsionally rigid manner to the drive wheel. As such, the stator is drive-connected to the crankshaft by means of this drive element and drive wheel.

A corresponding rotor is engaged with the stator, and is joined to the camshaft in a torsionally rigid manner. The camshaft has cam lobes thereon which push against gas exchange valves in order to open them. By rotating the camshaft, the opening and closing time points of the gas exchange valves are shifted so that the internal combustion engine offers its optimal performance at the speed involved.

To optimize performance during operation of the internal combustion engine, the angular position of the camshaft is continuously changed relative to the drive wheel depending on the relative position of the rotor relative to the stator. Specifically, the engine RPM and the amount of torque and horsepower the engine is required to produce are the bases for the timing adjustments. These adjustments take place while the engine is in operation. This makes variable valve timing possible because intake and exhaust valve timing is constantly adjusted throughout the RPM range. The performance benefits include the increase of engine efficiency and improvement of idle smoothness. The engine can also deliver more horsepower and torque versus a similar displacement engine with conventional valve timing. This also allows the engine to have improved fuel economy and results in the engine emitting fewer hydrocarbons.

The stator includes webs which protrude radially toward a central axis of the stator. Intermediate spaces are formed between the adjacent webs, and pressure medium is introduced to these spaces via a hydraulic valve. The rotor includes vanes which protrude radially away from the central axis of the rotor, and project between adjacent webs of the stator. These vanes of the rotor subdivide the intermediate spaces between webs of the stator into two pressure chambers (often referred to as "A" and "B", respectively). In order to change the angular position between the camshaft and the drive wheel, the rotor is rotated relative to stator. For this purpose, depending on the desired direction of rotation each time, the pressure medium in every other pressure chamber ("A" or "B") is pressurized, while the other pressure chamber ("B" or "A") is relieved of pressure toward the tank.

During some operating states of the internal combustion engine, it becomes imperative to lock the position of the rotor relative to the stator. For this purpose, a valve timing control apparatus in the form of a lock pin may be utilized on the rotor for locking into a corresponding bore.

Some systems are configured such that this bore is provided at one end or the other of the rotor's range of motion relative to the stator (proximate one web or the other). Typically, it is at the fully retarded position at which the lock pin is configured to lock. Regardless, it is easier to effect locking of the rotor at one end or the other of its range of motion because then, in case of engine shut down, cam friction can be employed to move the rotor to the locked position, or a spring can even be used to overcome opposing friction to move the rotor to the locked position.

While there are advantages to providing a system which locks the rotor relative to the stator, there is difficulty in directing the rotor to a "mid-lock" position, i.e., a lock position which is not located at either one end or the other of the rotor's range of motion relative to the stator. Specifically, when a lock position is provided in between the fully retarded position and the fully advanced position (i.e., a mid-lock position), if the engine stalls or is shut down prior to controlling the rotor to the mid-lock position, conventional end-lock systems are not able to move the rotor to the correct position and lock the phaser.

U.S. Pat. No. 8,973,542 discloses a system which provides a mid-locking system which is configured to exhaust pressure medium from one side or the other of the vanes of the rotor, in order to move the rotor to its mid-lock position. The present invention is effectively an improvement over the system disclosed in the '542 patent.

SUMMARY OF THE INVENTION

An object of an embodiment of the present invention is to provide a valve timing control device or cam phaser which consumes less oil, reduces the amount of time it takes to get to a mid-lock position when oil pressure and flow are limited, and does not rely on electronic control to get to that mid-lock position.

Another object of an embodiment of the present invention is to provide a valve timing control device or cam phaser which uses cam torque to recirculate oil from one side of the vanes of its rotor to the other, in order to assist locating the cam phaser to its mid-lock position, despite there being little to no pressure from the oil pump.

In one example embodiment of the invention, a mid-locking phaser is provided which has a rotor-locating mechanism. The rotor-locating mechanism comprises directional feed and directional exhaust ports which function to automatically move the rotor to the mid-lock position, so the rotor can be locked relative to the stator, without having to rely on electronic control. Specifically, when the engine is shut down, the controller turns off the current. Therefore, during shut down, the sensors that determine the phase angle do not accurately read the position. The rotor-locating mechanism is configured to move the rotor to the mid-lock position automatically, without electronic control. Furthermore, oil is selectively fed to one chamber or the other depending on the position of the rotor relative to the stator. In other words, oil is not fed to both chambers, but only the chamber required. As such, oil consumption is reduced, and the time it takes to get to the mid-lock position is decreased when oil pressure and flow are limited.

Additionally, in some embodiments disclosed herein, cam torsionals recirculate the oil from one side to the other, achieving mid-lock positioning and locking, despite little to no oil pressure from the pump.

Additional advantages of the invention may be derived from the patent claims, the description and the drawings.

BRIEF DESCRIPTION OF THE DRAWINGS

The present invention will hereinafter be described in conjunction with the appended drawing figures, wherein like reference numerals denote like elements, and.

DETAILED DESCRIPTION

Figure 1:
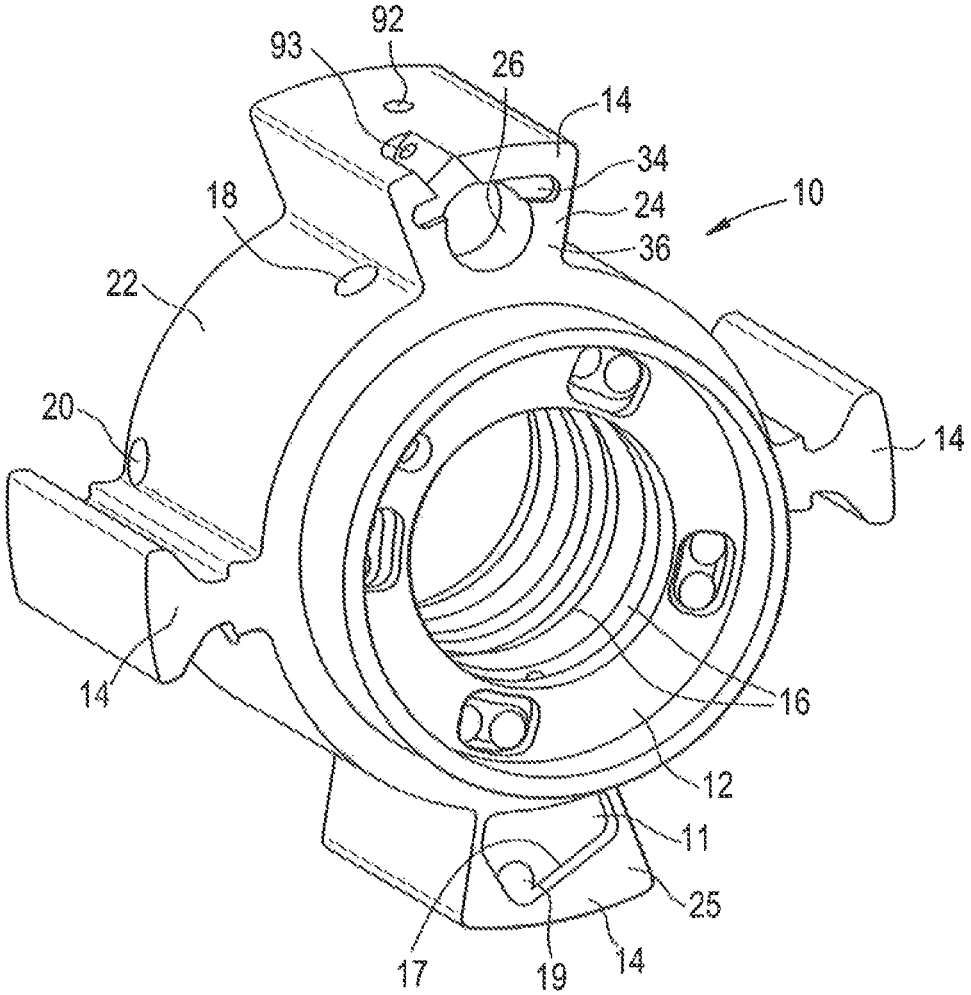
FIG. 1 is a perspective view of a rotor component of a valve timing control device or cam phaser which is in accordance with an embodiment of the present invention.

While this invention may be susceptible to embodiment in different forms, there are shown in the drawings and will be described herein in detail, specific embodiments with the understanding that the present disclosure is to be considered an exemplification of the principles of the invention, and is not intended to limit the invention to that as illustrated.

The present invention relates to a valve timing control device, in effect a cam phaser, for use with an internal combustion engine. A plurality of embodiments of the present invention are disclosed herein. The embodiments disclosed herein are effectively improvements over the system disclosed in U.S. Pat. No. 8,973,542, which is hereby incorporated herein by reference in its entirety.

A first embodiment will be described, and then additional embodiments will be described emphasizing the differences. First, the rotor and stator of each embodiment will be described, and then the hydraulic or oil control valve of each embodiment will be described. Finally, the different states will be described.

As shown in FIG. 1, the rotor 10 includes a hub 12, as well as vanes 14 which protrude radially away from the hub 12. The rotor 10 also includes annular channels 16 which communicate with additional channels 18, 20 (see FIG. 3) which lead to the outside surface 22 of the rotor 10. Channels 18 and 20 are similarly positioned, as shown, between each rotor vane 14. As will be described, these channels 16, 18, 20 provide fluid paths for pressure medium (i.e., oil).

Figure 3:
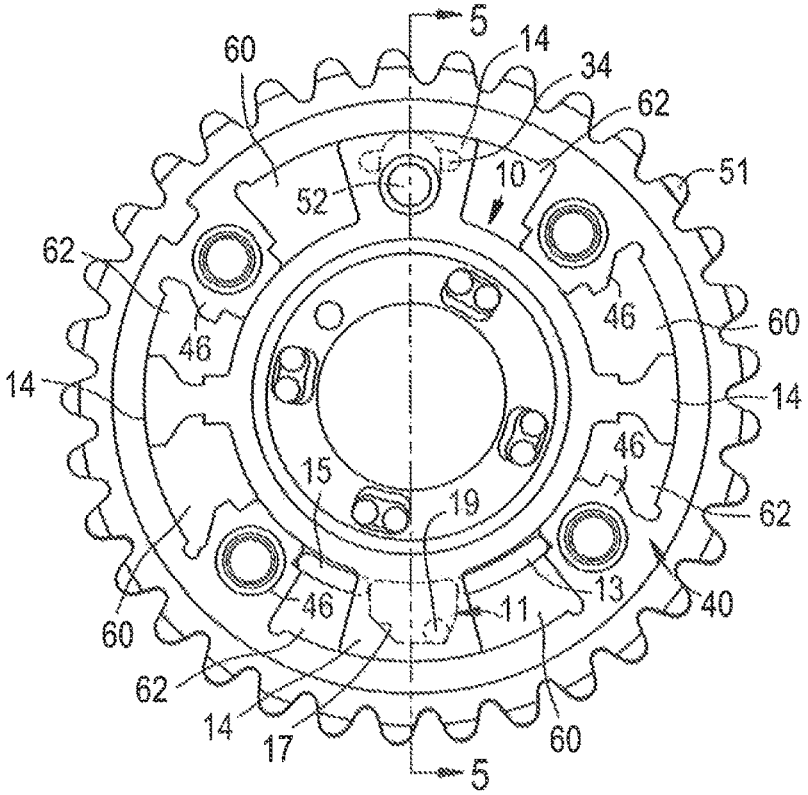
FIG. 3 shows (omitting a cover, for simplicity) the rotor and stator engaged with each other, and the rotor locked relative to the stator.
Figure 4:
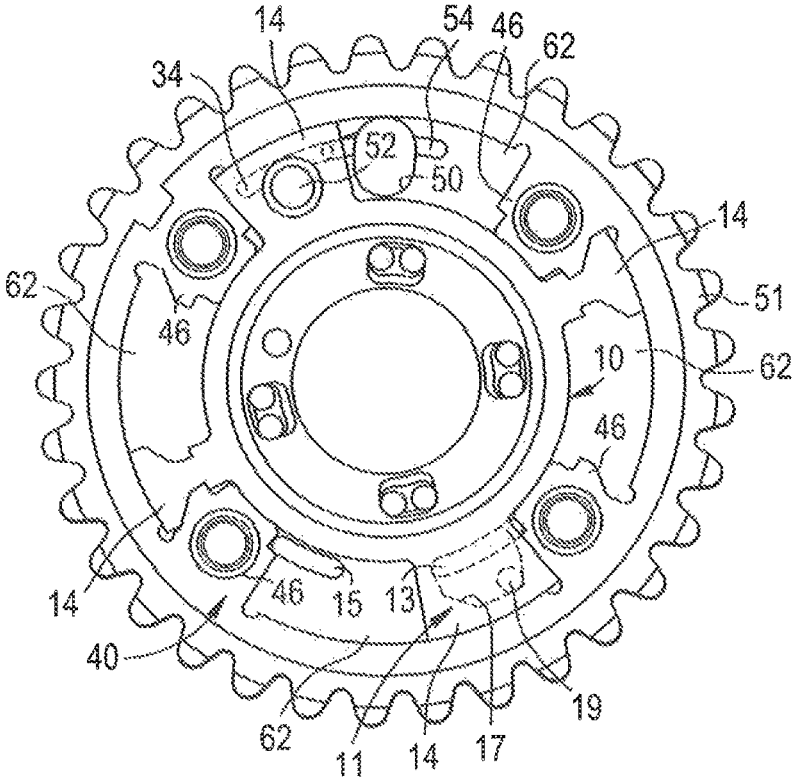
FIG. 4 is similar to FIG. 3, but shows the rotor unlocked relative to the stator, and the rotor rotated to its most advanced position relative to the stator.
Figure 5:
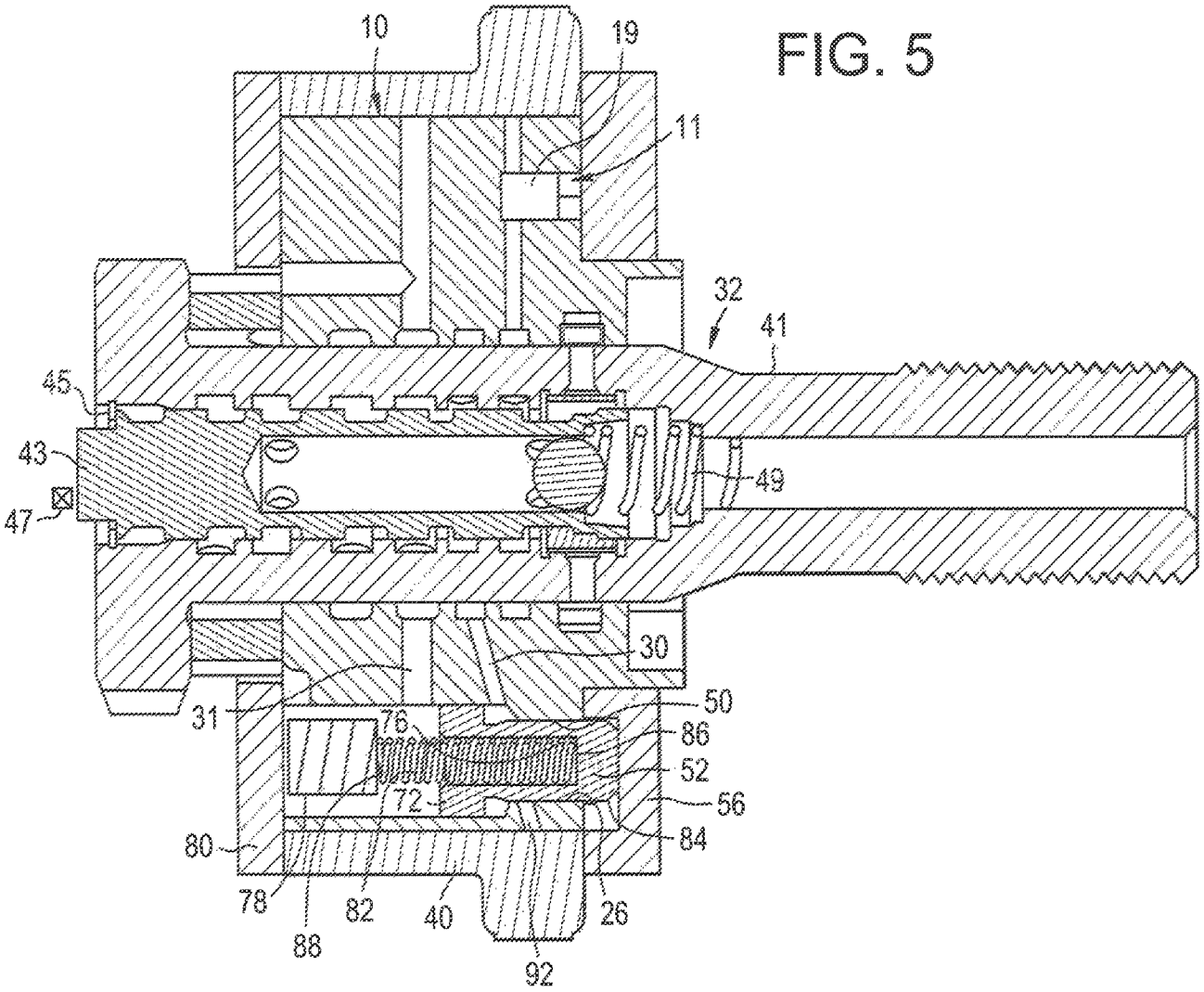
FIG. 5 is a cross-sectional view taken along line 5-5 of FIG. 3, showing an oil control valve and a pressure medium control valve of the valve timing control device.

The rotor 10 also includes, in one (24) of its vanes 14, a pressure medium control valve chamber 26. As shown in FIGS. 3-5, a pressure medium control valve such as a lock pin 52 is disposed in this chamber 26, and the rotor 10 provides internal fluid channels 30 which lead to this chamber 26 and which communicates with at least one of the annular channels 16 provided in the hub 12 of the rotor 10. As such, pressure medium can flow between the pressure medium control valve chamber 26 and a hydraulic or oil control valve 32.

As shown in FIG. 1, proximate the pressure medium control valve chamber 26, and in fluid communication therewith, is a centering slot 34 formed on the external surface 36 of the vane 24 of the rotor 10. As will be described more fully later herein, this centering slot 34 works to provide that pressure medium can move along the centering slot 34 to the lock pin 52 when the rotor 10 is in certain positions relative to the stator 40, during certain stages of operation of the engine.

Preferably, the rotor 10 has no sealing on its outside. Instead, preferably sealing is effected by the length of the vanes 14 (i.e., sealing length). Preferably, there is no sealing because if a slot had to be provided for a seal on the radial outside of the vanes 14, this would reduce the available space for the pressure medium control valve chamber 26. That being said, sealing can be provided while still staying very much within the scope of the present invention.

In addition to centering slot 34, the rotor 10 includes at least one additional slot, such as an additional slot 11 in one (25) of its vanes 14, for supplying pressure medium to either chamber 60, 62, depending on the position of the rotor 10 relative to the stator 40. This will be described in more detail hereinbelow. As shown in FIG. 1, the slot 11 may comprise a recess 17 provided in the external surface 36 of the rotor 10 and a fluid passageway 19 into the vane 25 disposed in the recess 17, wherein the fluid passageway 19 is in fluid communication with the oil control valve 32 as shown in FIG. 5.

Figure 2:
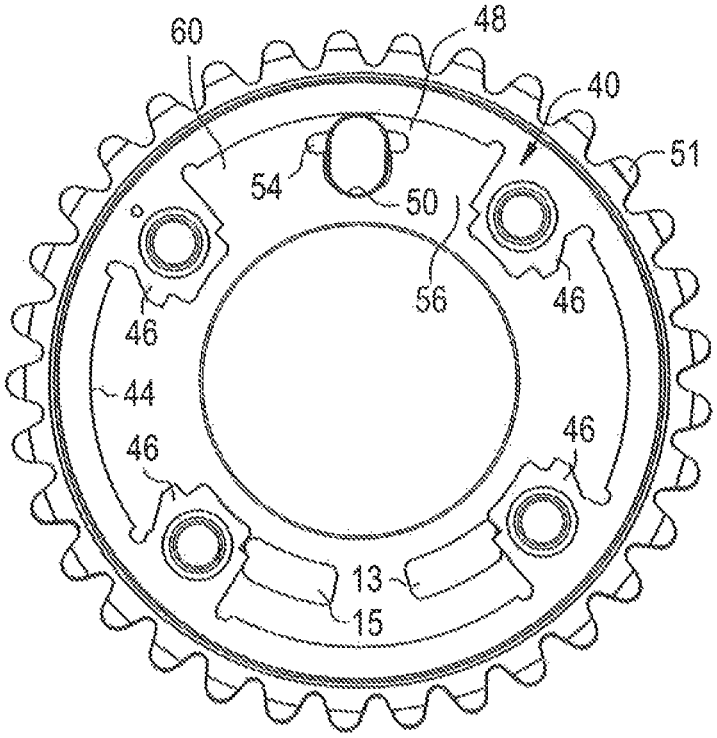
FIG. 2 is a front view of a stator component of the valve timing control device.

As shown in FIG. 2, another component of the valve timing control device comprises a stator 40. The stator 40 is drive-connected to a crankshaft (not shown) by means of a drive element (also not shown) which engages a drive wheel 51. The stator 40 comprises a cylindrical stator base 44, and webs 46 protrude from the base 44, radially toward the inside. The webs 46 are spaced apart, and in one of these spaces 48, between two of the webs 46, is a lock pin bore 50 configured to receive the lock pin 52, thereby locking the position of the rotor 10 relative to the stator 40 (see FIGS. 3 and 5).

As shown in FIG. 2, preferably a centering slot 54 is also formed in an external surface plate 56 (such as sprocket or cover) of the stator 40, proximate the lock pin bore 50. As will be described more fully later herein, this centering slot 54 works to provide that pressure medium can move from one of the chambers through this slot then along the centering slot 34 in the rotor 10, and to the pressure medium control valve chamber 26, when the rotor 10 is in certain positions relative to the stator 40, during certain stages of operation of the engine.

In addition to centering slot 54, the stator surface plate (can be sprocket or cover) 56 includes additional recesses or slots 13, 15, with which the slot 11 provided in the rotor 10 cooperates, for supplying pressure medium to either chamber 60, 62, depending on the position of the rotor 10 relative to the stator 40. Each of the slots 13, 15 may comprise a recess in the stator surface plate 56.

One or more of the rotor 10, stator 40 and stator surface plate 56 may be sintered, during which time the slots 11, 13, 15, 34, 54 become formed. While FIGS. 1 and 2 depict a centering slot 34, 54 being provided on each of the rotor 10 and the stator surface plate 56, respectively, it is possible while still staying well within the scope of the present invention to provide a centering slot on only one of these components, such as the stator surface plate 56, and/or to provide fluid channels which look completely different from the centering slots 34, 54 which are depicted herein, so long as some form of fluid path is provided from the pressure chambers 60, 62 existing between the vanes 14 and webs 46, to the pressure medium control valve chamber 26. Furthermore, slots 11, 13 and 15 can also be provided as looking much different than that what is shown in FIGS. 1 and 2, while still staying well within the scope of the present invention. Additionally, fewer or more slots can be provided.

Additionally, while the term "centering" is used herein, it must be appreciated that the lock pin bore 50 need not be (and most likely would not be) provided exactly between two adjacent webs 46 of the stator 10; however, it is preferred that the lock pin bore 50 be provided at some intermediate position between the fully retarded and fully advanced positions of the rotor 10.

FIGS. 3 and 4 show the rotor 10 engaged with the stator 40. Specifically, the rotor 10, stator 40 and surface plate 56 are engaged with each other such that the centering slots 34, 54 face each other (i.e., the external surface 36 of the rotor 10 faces the exterior surface 56 of the stator 40), and the slot 11 in the rotor 10 faces the slots 13, 15 in the surface plate 56. The rotor 10 and stator 40 are coaxial relative to each other, and each of the vanes 14 of the rotor 10 is disposed between two adjacent webs 46 of the stator 10. As such, pressure chambers 60, 62 are provided between each vane 14 and web 46. The rotor 10 provides at least one fluid path to each pressure chamber 60, 62, such that pressure medium can flow back and forth between each pressure chamber 60, 62 and the oil control valve 32 (see FIG. 5). More specifically, the internal channels 16, 18, 20 of the rotor 10 are configured such that there are two sets of pressure chambers 60, 62 disposed between the vanes 14 of the rotor 10 and the webs 46 of the stator 40, wherein every other chamber 60 is a retard pressure channel, and the remaining pressure chambers 62 are advancement pressure channels. During operation, providing more pressure medium pressure in the advancement chamber 62 than the retard chamber 60 causes the rotor 10 to move counter-clockwise relative to the stator 10. In this case, pressure medium from the compressed retard chamber 60 will be drained to the tank T. On the other hand, providing more pressure medium pressure in the retard chamber 60 than the advancement chamber 62 causes the rotor 10 to move clockwise relative to the stator 40. In this case, pressure medium from the compressed advancement chambers 62 will be drained to the tank T.

Although a certain number of vanes and webs are shown in the drawings, a different number of vanes and webs can certainly be provided. Also, not every chamber needs to be active, meaning that advance and retard oil need not go to every chamber.

FIG. 3 shows a state where the rotor 10 is in a position relative to the stator 40 where the lock pin 52 can be engaged in the lock pin bore 50. In contrast, FIG. 4 shows the rotor 10 unlocked and shows a specific position—the rotor 10 in its most advanced position relative to the stator 40. Of course, the rotor 10 can be in other positions relative to the stator 40, and the specific position shown in FIG. 4 is merely provided as an example.

FIG. 5 is a cross-sectional view taken along line 5-5 of FIG. 3. Although not specifically shown in FIG. 5, the rotor 10 is joined to a camshaft in a torsionally rigid manner, and the camshaft includes one or more cam lobes which are configured to push against gas exchange valves in order to open them.

As shown in FIG. 5, the oil control valve 32 is disposed proximate the rotor 10. The oil control valve 32 is controlled via electronics to effectively provide for the controlled flow of pressure medium through the oil control valve 32, in order to control the camshaft. The oil control valve 32 includes a bolt 41 (which engages the camshaft, which is not shown), and a spool 43 is disposed in the bolt 41. The spool 43 is retained in the bolt 41 by a retaining member 45, and the spool 43 moves back and forth relative to the bolt 41. The movement is controlled via electronics to effectively provide for the controlled flow of pressure medium, in order to control the camshaft. Specifically, a solenoid 47 (shown in FIG. 5) engages one end of the bolt 41, while a biasing member, such as a compression spring 49, engages the opposite end of the bolt 41. As such, the solenoid 47 effectively sets and controls the position and movement of the spool 43 relative to the bolt 41, thereby controlling the flow of pressure medium and controlling the camshaft with which the oil control valve 32 is engaged.

The oil control valve 32 includes a plurality of passageways or ports through which pressure medium can flow, both to and from, the oil control valve 32. These ports are indicated in FIGS. 6-10 using letters. Specifically, pressure medium flows from an oil pump (not shown), through port P, to the oil control valve 32. Additionally, pressure medium flows from the oil control valve 32, through ports T, in order to drain to tank (not shown). As shown, there are preferably two tank (T) ports—one through the side of the bolt 41, and another one at the end of the oil control valve 32. Pressure medium flows to and from advancement chamber 62 through port A, and flows to and from retard chamber 60 through port B. Pressure medium flows from the pressure medium control valve 52, through port L, to the oil control valve 32. Finally, pressure medium can flow from the oil control valve 32, through port S, to the slot 11 in the rotor 10. Depending on the position of the oil control valve spool 43 and the rotor 10 relative to the stator 40, this may result in pressure medium being supplied to either chamber 60 or 62 via slot 13 or 5, respectively.

While FIG. 5 shows a preferred oil control valve 32 which can be used in association with the rotor 10 and stator 40 previously described, other oil control valves can be used while still staying very much within the scope of the present invention.

Depending on the state of operation, pressure medium can be supplied to, and tanked (i.e., exhausted) from, the chambers 60, 62 via channels 16, 18, 20 in the rotor 10. Pressure medium can also be supplied to the chambers 60, 62 via slot 11 in the rotor 10 and either slot 13 or 15 in the stator surface plate 56, depending on the position of the rotor 10 relative to the stator 40 at the time. Pressure medium can also be tanked (i.e., exhausted) from the chambers 60, 62 via the pressure medium control valve chamber 26.

As discussed above, the oil control valve 32 includes a bolt 41 (which engages the camshaft), and a spool 43 is disposed, and retained, in the bolt 41. The spool 43 moves back and forth relative to the bolt 41, and this movement is controlled via electronics to effectively provide for the controlled flow of pressure medium, in order to control the camshaft. The spool 43 has an exterior surface profile which cooperates with an interior surface profile of the bolt 41, to provide for fluid flow between the different ports of the oil control valve 32. Specifically, pressure medium flows within the spool 43, as well as between the external surface of the spool 43 and the internal surface of the bolt 41. This will be described in more detail later hereinbelow, when the various states of the oil control valve 32 are described.

In the meantime, the pressure medium control valve or lock pin 52 will now be described. As shown, preferably the lock pin 52 is generally cylindrical, is generally non-stepped, but has a head 72. The lock pin 52 also preferably includes an internal shoulder 76. A cap 78 is preferably provided, and the cap 78 abuts a cover 80 which is fixed to the stator 40. A biasing member, such as a compression spring 82, is configured to engage the lock pin 52 and push the lock pin 52 into engagement with the lock pin bore 50 in the stator surface plate 56, such that the position of the rotor 10 becomes effectively locked with regard to the stator 40. Preferably, the portion 84 of the lock pin 52 which engages in the lock pin bore 50 has a cylindrical outer surface as opposed to being tapered; however, a tapered lock pin can be used while still staying well within the scope of the present invention. Regardless, while one end 86 of the compression spring 82 engages the internal shoulder 76 of the lock pin 52, the other end 88 of the compression spring 82 engages the cap 78. While the end 86 of the compression spring 82 is shown as engaging an internal shoulder 76 in the lock pin 52, this end 86 of the compression spring 82 may engage a rear surface of the lock pin 52, with the other end 88 of the compression spring 82 engaging in a recess provided in the cap 78. The compression spring 82 can be implemented in many ways while still staying very much within the scope of the present invention. In fact, while the biasing member is depicted as being a compression spring 82, the biasing member may take other forms so long as the lock pin 52 is urged toward the lock pin bore 50 which is provided in the stator surface plate 56.

As shown in FIG. 5, the rotor 10 provides fluid passageways 30, 31 which lead to the pressure medium control valve chamber 26. As such, pressure medium can flow between the pressure medium control valve chamber 26 via channels 30, 31, through the rotor 10, along at least one of the annular channels 16 to the oil control valve 32. Also, the flow from the oil control valve 32 leads to tank T which is established by the crankcase when the oil control valve is in a position to "center" and engage the lock pin 52. At times, as will be described in more detail hereinbelow, the pressure medium pushes on the head 72 and the base of the lock pin 52 in order to overcome the force of the compression spring 82, such that the lock pin 52 withdraws and unseats from the lock pin bore 50, thereby freeing the rotor 10 from the stator 40 such that the rotor 10 can pivot relative to the stator 40.

While the centering slots 34, 54 are inaccessible to the pressure chambers 60, 62 when the position of the rotor 10 is locked relative to the stator 40 via the lock pin 52 (or when the lock pin 52 is at least generally aligned with the lock pin bore 50), preferably the centering slots 34, 54 on the rotor 10 and stator surface plate 56 are configured such that they are in fluid communication with each other when the rotor 10 is not "centered" relative to the stator 40. Similarly, slot 11 in the rotor 10 and either slot 13 or 15 in the stator surface plate 56 are configured such that they are in fluid communication with each other when the rotor 10 is not "centered" relative to the stator 40.

In FIGS. 1 and 5, opening 92 is merely a result of manufacturing the rotor 10. Specifically, the rotor 10 is drilled into in order to form passageways 30, 31. This drilling operation results also in the formation of opening 92. In other words, the drill drills into the rotor 10 forming opening 92 and then drills further into the rotor 10 forming passageway 30 (see FIG. 5). Passageway 30 is what transfers the oil to the oil control valve 32. In FIG. 1, opening 93 also connects to passageway 31, routing oil from centering slot 34 (and centering slot 54, if the rotor is not "centered").

Figure 6:
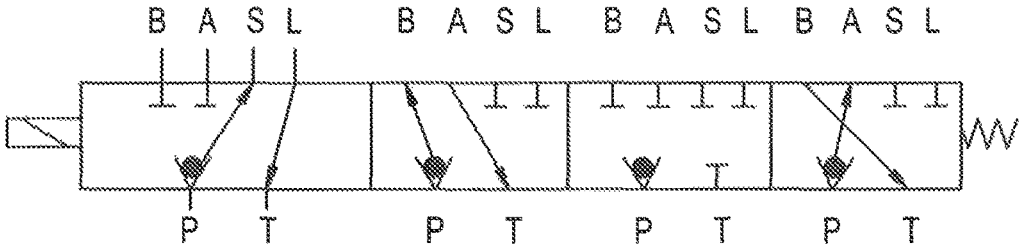
FIG. 6 is a state diagram showing the various states of the oil control valve.
Figure 7:
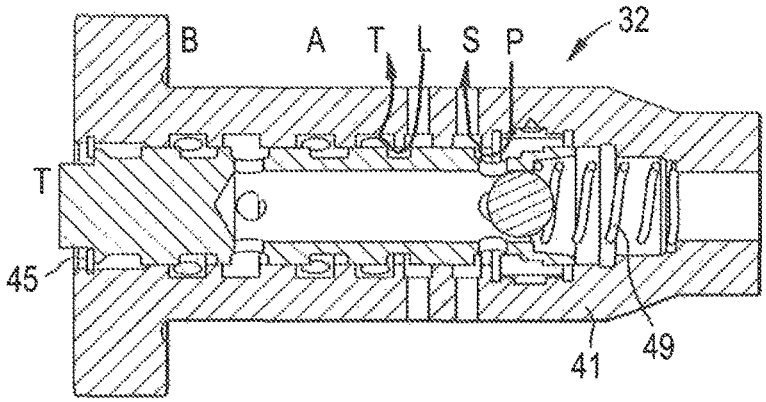
FIGS. 7-10 show the pressure medium control valve in various states, during various stages of operation of the engine.
Figure 8:
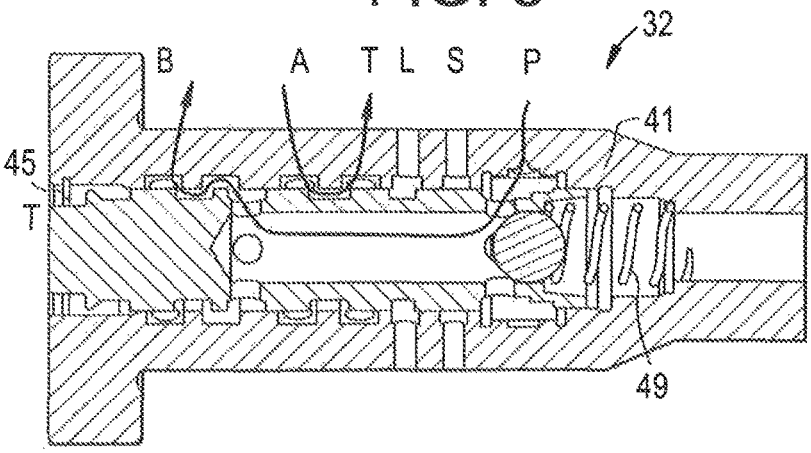
Figure 9:
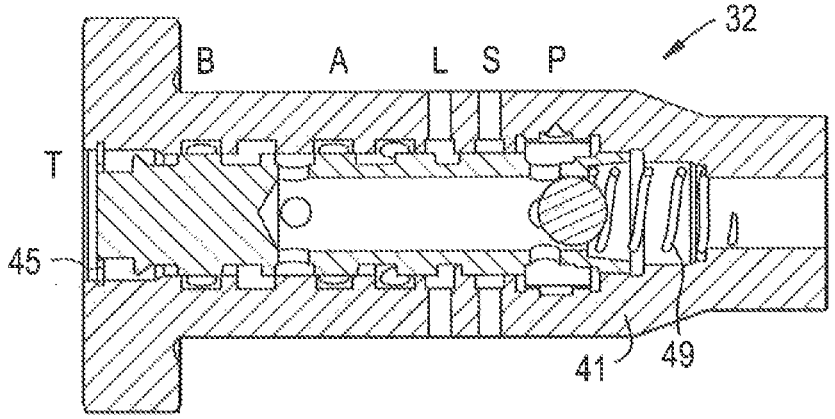
Figure 10:
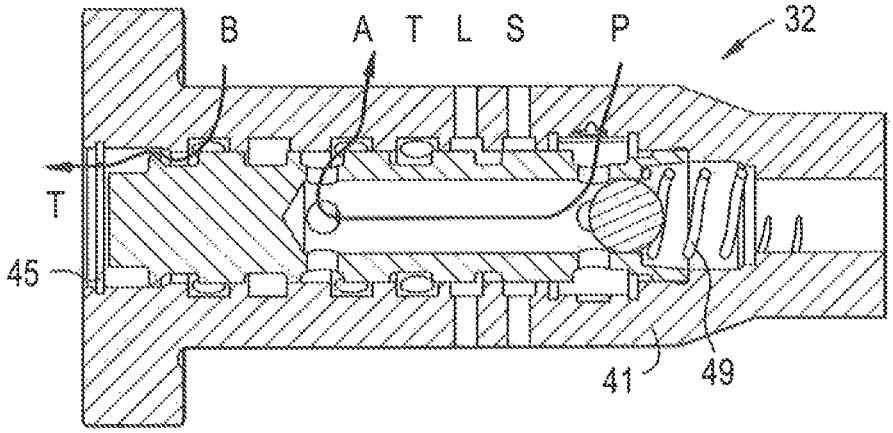

The various states of the oil control valve 32 will now be described. FIG. 6 is a state diagram which illustrates the various states of the oil control valve 32, while FIGS. 7-10 show the position of the spool relative to the bolt in each of those states. Moving from left to right in FIG. 6, the first state (shown in FIG. 7) is for self-centering and locking the rotor relative to the stator. This state occurs, for example, upon engine shut down or stall, due to the spring pushing the spool to its end-most position. In this state, the rotor is automatically urged to its mid-lock position so the lock pin can lock the rotor relative to the stator. Both chambers 60 and 62 are effectively blocked at the oil control valve 32 (i.e., ports A and B are blocked by the spool). Pressure medium flows from the oil pump into port P, out port S, and to the slot 11 in the rotor 10. Assuming the rotor 10 is not centered relative to the stator 40, pressure medium enters only one of the chambers 60 or 62, depending on whether slot 11 is in communication with slot 13 or slot 15. This is determined by the position of the rotor 10 relative to the stator 40 at the time. Additionally, pressure medium flows from the pressure medium control valve chamber 26, into port L, and out port T to the tank. Assuming the rotor 10 is not centered relative to the stator 40, pressure medium from the other chamber 62 or 60 is tanked (i.e., exhausted) out the pressure medium control valve chamber 26 in this manner, via the oil control valve 32. On the other hand, if the rotor 10 is centered relative to the stator 40, the rotor 10 covers the centering slot 54 and any residual pressure is tanked (i.e. exhausted) out of the pressure medium control valve chamber 26, so the lock pin 52 drops and locks the rotor 10 relative to the stator 40 for shut down.

In the second state (shown in FIG. 8), pressure medium is provided from the oil pump to the retard chamber 62, and the advancement chamber 60 drains to tank. Specifically, pressure medium flows from the oil pump into port P, out port B, and to the retard chamber 62. Additionally, pressure medium flows from the advancement chamber 60, to port A and out port T to tank.

The third state (shown in FIG. 9) is a "null" state, during which time pressure medium does not flow through the oil control valve 32.

In the fourth state (shown in FIG. 10), pressure medium is provided from the oil pump to the advancement chamber 60, and the retard chamber 62 drains to tank. Specifically, pressure medium flows from the oil pump into port P, out port A, and to the advancement chamber 60. Additionally, pressure medium flows from the retard chamber 62, to port B and out port T to tank.

With regard to stroke of the spool relative to the bolt, in the first state (shown in FIG. 7), the oil control valve 32 can have a stroke of 0 mm. In the second state (shown in FIG. 8), the oil control valve 32 can have a stroke of 1.5 mm. In the third state (shown in FIG. 9), the oil control valve 32 can have a stroke of 2.6 mm. Finally, in the fourth state (shown in FIG. 10), the oil control valve 32 can have a stroke of 3.7 mm. Of course, other stroke lengths are entirely possible.

The valve timing control device described above is configured to automatically locate to its mid-lock position, without having to rely on electronic control. It also consumes less oil, and reduces the amount of time it takes to get to a mid-lock position when oil pressure and flow are limited.

Figure 11:
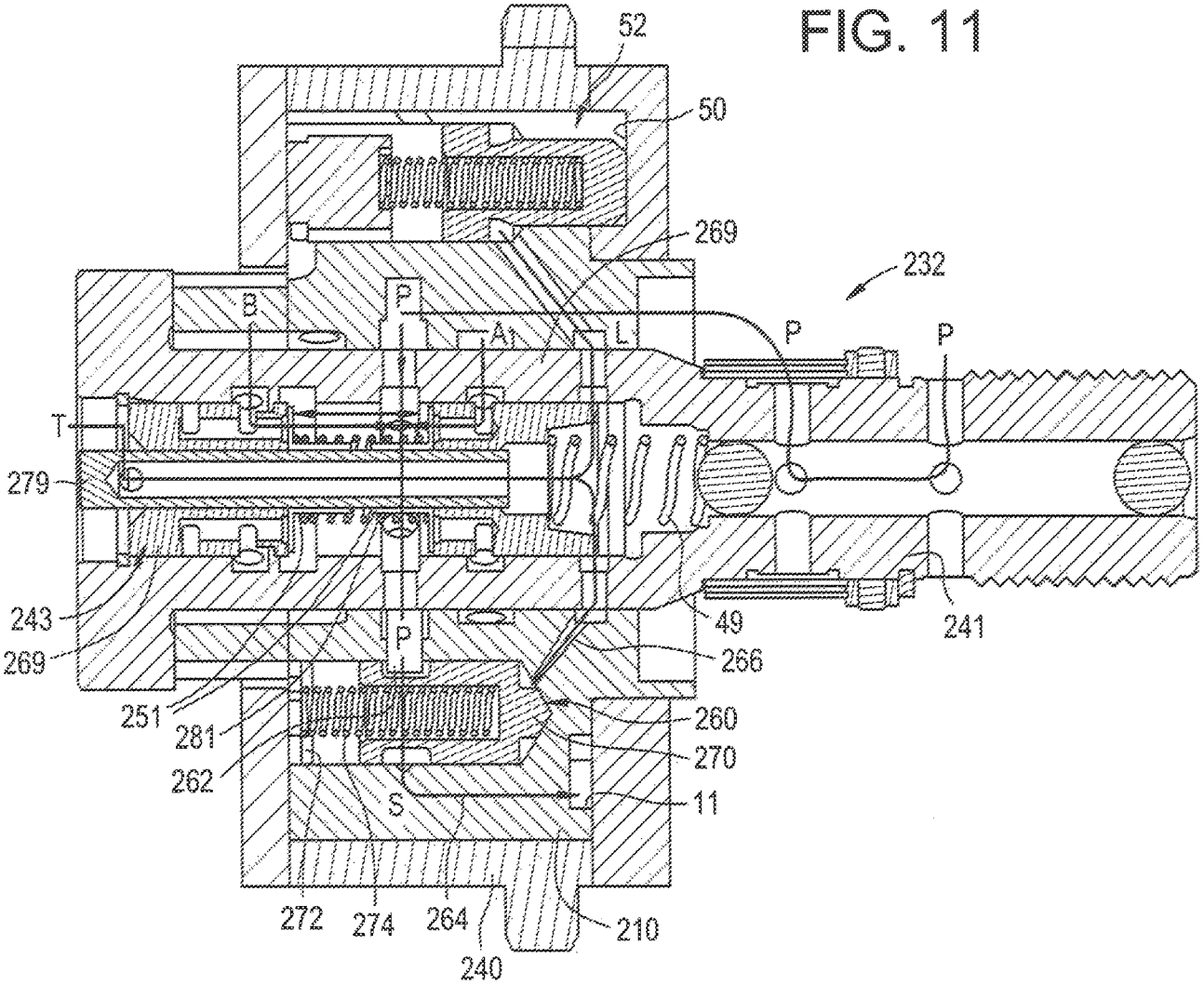
FIG. 11 is a cross-sectional view showing a supply valve, an oil control valve, and a pressure medium control valve of a valve timing control device, which is in accordance with a preferred embodiment of the present invention.

FIG. 11 illustrates a valve timing control device which is in accordance with a preferred embodiment of the present invention. The embodiment is preferred because it not only provides for directional supply, but also provides for cam torque recirculation. The embodiment provides exceptional performance with regard to locating the rotor to its mid-lock position, from extreme positions (i.e., fully advanced or fully retarded), when shutting down or stalling an engine.

The valve timing control device shown in FIG. 11 is similar to that which has been previously described in that it includes a rotor 210, stator 240 and oil control valve 232. The stator 240 may be provided as being very much like the stator 40 previously described. With regard to the rotor 210, the rotor is preferably provided as having a lock pin 52 and a directional supply slot 11 much like the rotor 10 previously described. However, as shown in FIG. 11, in addition to the lock pin 52 being provided in one of the vanes of the rotor 210, another vane of the rotor preferably includes a supply valve 260. This supply valve 260, when open, supplies oil to the directional supply (i.e., the slot 11 in the rotor 210), which oil thereafter may supply the advancement ("A") or retard ("B") chamber, depending on the position of the rotor 210. The rotor 210 also includes passageways 262, 264, 266 associated with the supply valve 260. Specifically, one or more passageways 262 are provided in the rotor 210 for fluid communication between the supply valve 260 and the oil control valve 232 for receiving oil from the oil pump through the oil control valve 232. One or more passageways 264 are also provided in the rotor 210 for fluid communication between the supply valve 260 and the slot 11 on the rotor 210 for supplying oil to said slot 11. Finally, one or more passageways 266 are also provided in the rotor 210 for fluid communication between the oil control valve 232 and the supply valve 260 for supplying oil to the supply valve 260 in order to open the supply valve 260, and for receiving oil from the supply valve 260 when the supply valve 260 is closing.

FIG. 11 shows one possible configuration for the supply valve 260. As shown, the supply valve 260 may comprise a main body 270, a cap 272, and a biasing member such as a compression spring 274 which is disposed between the main body 270 and the cap 272. When the front end of the supply valve 260 is vented, the spring 274 urges the supply valve 260 open (i.e., by urging the main body 270 forward). When the supply valve 260 is open, oil can flow through the supply valve 260 to the directional supply (i.e., port 11). On the other hand, when oil pressure at the front end of the supply valve 260 pushes the main body 270 against the spring 274, the supply valve 260 closes and oil cannot travel through the supply valve 260 to the directional supply (i.e., port 11). Of course, the supply valve 260 may have different configurations and components while still staying very much within the scope of the present invention.

With regard to the oil control valve 232, the oil control valve 232 may comprise a bolt 241, a spool 243 in the bolt 241, and check valves 251. The check valves 251 are associated with fluid flow between the oil control valve 232 and both the advancement (A) and retard (B) chambers. Because check valves are provided, and in order to facilitate manufacturing, preferably the spool 243 is formed of multiple parts or lands 269. Preferably, these lands 269 are pressed onto a pin or spool pin 279, and a spring 281 is disposed between the lands 269. Of course, the oil control valve 232 may have different configurations and components while still staying very much within the scope of the present invention.

Regardless of its exact configuration, the oil control valve 232 provides a plurality of ports which facilitate fluid flow. These ports are identified with letters in the Figures. Specifically, the letter P identifies fluid flow from the oil pump, the letter A identifies fluid flow associated with the advancement chamber, the letter B identifies fluid flow associated with the retard chamber, the letter S identifies fluid flow to the directional supply (i.e., slot 11), the one letter L identifies fluid flow associated with unlocking the lock pin (and the lock pin locking), the other letter L identifies fluid flow associated with opening the supply valve (and the supply valve locking), and the letter T identifies fluid flow to tank T. In fact, these letter conventions are used herein with regard to all embodiments described. These letter conventions are common in the industry.

Figure 12:
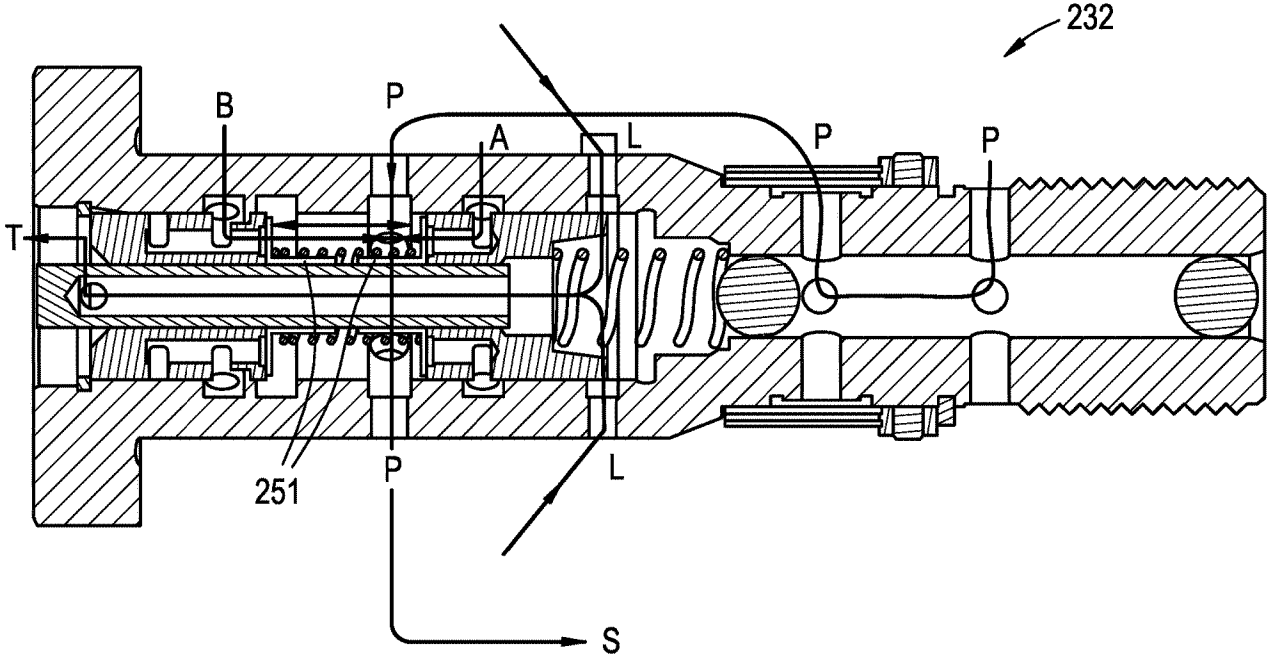
FIGS. 12-16 are similar to FIG. 11, but show the oil control valve in different states.

FIGS. 11 and 12 show one state of the oil control valve 232. This state is for self-centering and locking the rotor 210 relative to the stator 240. This state occurs, for example, upon engine shut down or stall, due to the spring 49 pushing the spool 243 to its end-most position. In this state, the rotor 210 is automatically urged to its mid-lock position so the lock pin 52 can lock the rotor 210 relative to the stator 240. While one chamber (either the advancement (A) or the retard (B) chamber, depending on the position of the rotor 210) exhausts into through the lock pin 52 (i.e., via centering slots 34, 54 (see FIGS. 1 and 2)), a directional supply of oil is provided to the other chamber via the slot 11 and either slot 13 or 15 (see FIG. 2). The fluid path for the exhaustion through the lock pin 52 is shown in FIGS. 11 and 12, and provides that oil flows from the lock pin 52, into the oil control valve 232, and to tank T. FIGS. 11 and 12 also show the fluid path for supplying oil to the directional supply (i.e., port 11). As shown, the front end of the supply valve 260 is vented through the oil control valve 232 to tank T. Therefore, the spring 274 pushes the main body 270 of the supply valve 260, and the supply valve 260 is therefore open to allow oil to flow therethrough to the directional supply (i.e., port 11). Oil is supplied to the directional supply by the oil pump, via the oil control valve 232 and the supply valve 260. During this state, oil pressure from the oil pump is blocked to the advancement (A) and retard (B) chambers via the check valves 251 and the spool lands 269. However, cam torsionals can open a check valve 251 and recirculate oil to assist the oil pump pressure for supplying oil to the directional supply (i.e., port 11). Due to exhausting the one chamber (A or B) through the lock pin 52 plus recirculating the exhausting side to (P), and supplying the other chamber (B or A) via the directional supply plus assisted with oil recirculation, the lock pin 52 eventually locates over the lock pin bore 50, and locks the rotor 210 relative to the stator 240. By providing cam torsional recirculation, moving the rotor to its mid-lock position can be achieved quicker, despite there being little to no oil pump pressure.

Figure 13:
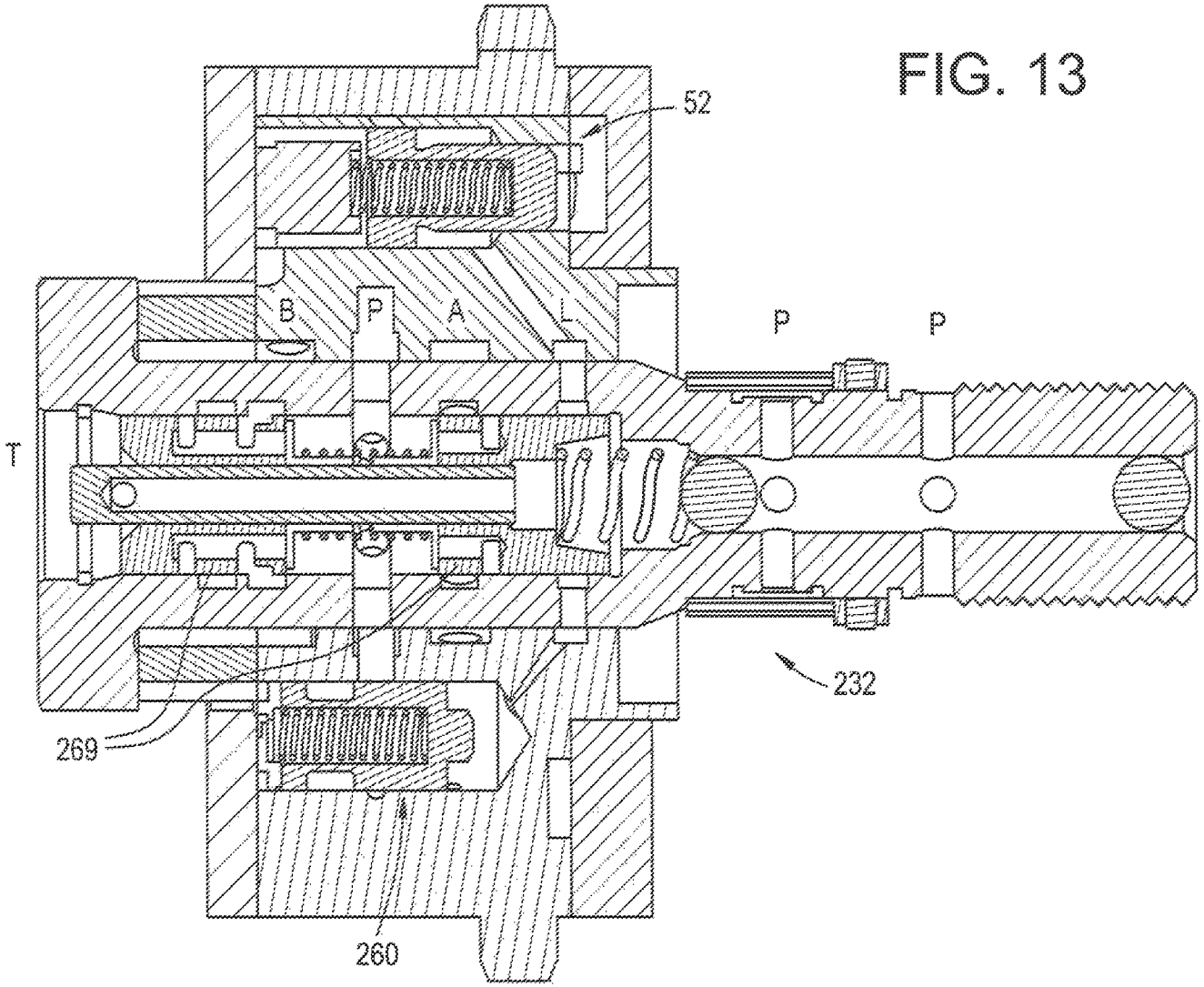

FIG. 13 shows the lock pin 52 in its locked state, and the supply valve 262 in its closed state. These states apply to all of the different oil control states shown in FIGS. 14-16.

Figure 14:
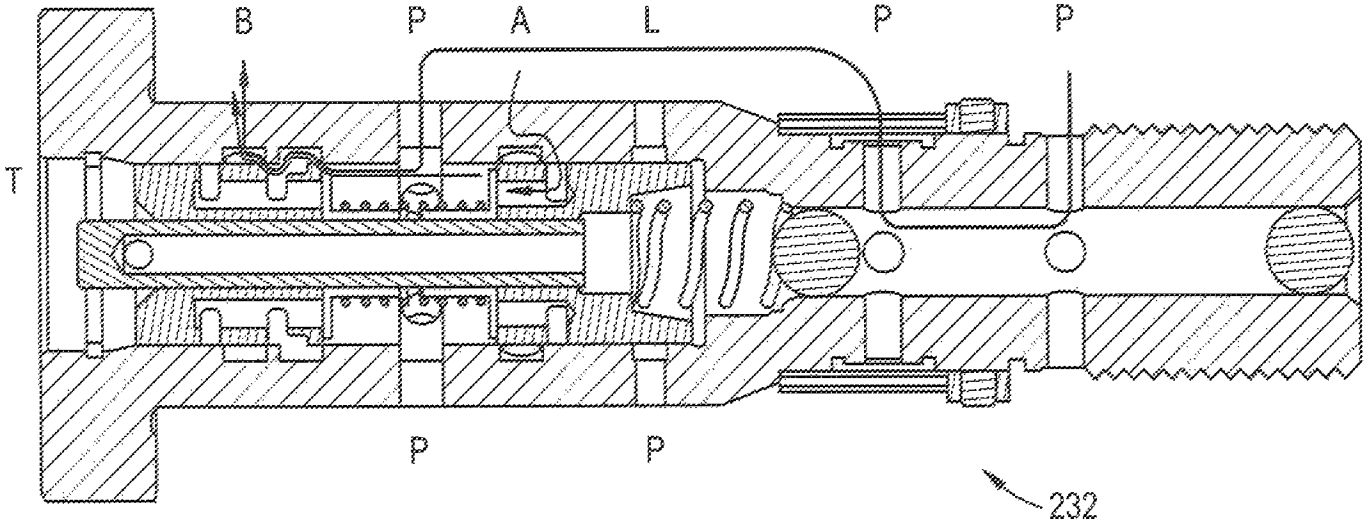

FIG. 14 shows a state of the oil control valve 232, during which time pressure from either chamber (i.e., either the advancement (A) or retard (B) chamber) unlocks the lock pin 52 (via port 34 and 54, see FIGS. 1-3), and pressure is routed through the oil control valve 232 to the supply valve 260 (i.e., oil is provided to the front end of the supply valve 260), thereby closing the supply valve 260, and preventing supply pressure from entering the directional supply port (i.e., slot 11). During this state of the oil control valve 232, the oil control valve 232 (i.e., the spool thereof) blocks the lock pin 52 from exhausting, thereby allowing pressure to build up. At this time, the lock pin 52 pushes against its spring 82 and is unlocked. Additionally, the supply valve 260 pushes against its spring 274 and blocks fluid flow from the oil pump from being provided to the directional supply (i.e., port 11). The oil control valve 232 allows the oil pump to supply oil to the retard chamber (B). However, oil from the oil pump is blocked from entering the advancement chamber (A) due to the oil control valve check valve 251 associated with that chamber. When the pressure of the advancement chamber (A) is greater than the oil pump pressure due to cam torsionals, the oil control valve check valve 251 associated with the advancement chamber (A) opens and oil from that chamber assists the oil pump and flows to the retard chamber (B). This assistive flow is shown in FIG. 14, and provides that the rotor 210 can be more quickly located to a retard position, despite there being little to no oil pressure.

Figure 15:
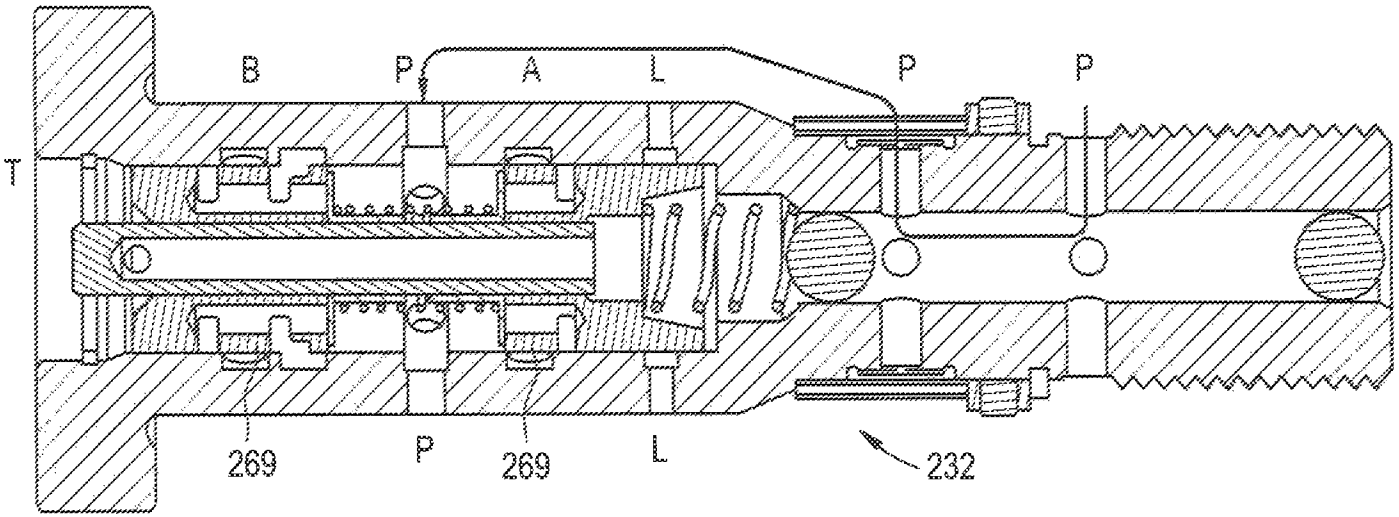

FIG. 15 shows another state of the oil control valve. This state is very much like the state shown in FIG. 14 (i.e., the lock pin 52 is unlocked and the supply valve 260 is closed), except that in this state, the spool lands cover both the A and B ports such that oil cannot enter or exit the phaser.

Figure 16:
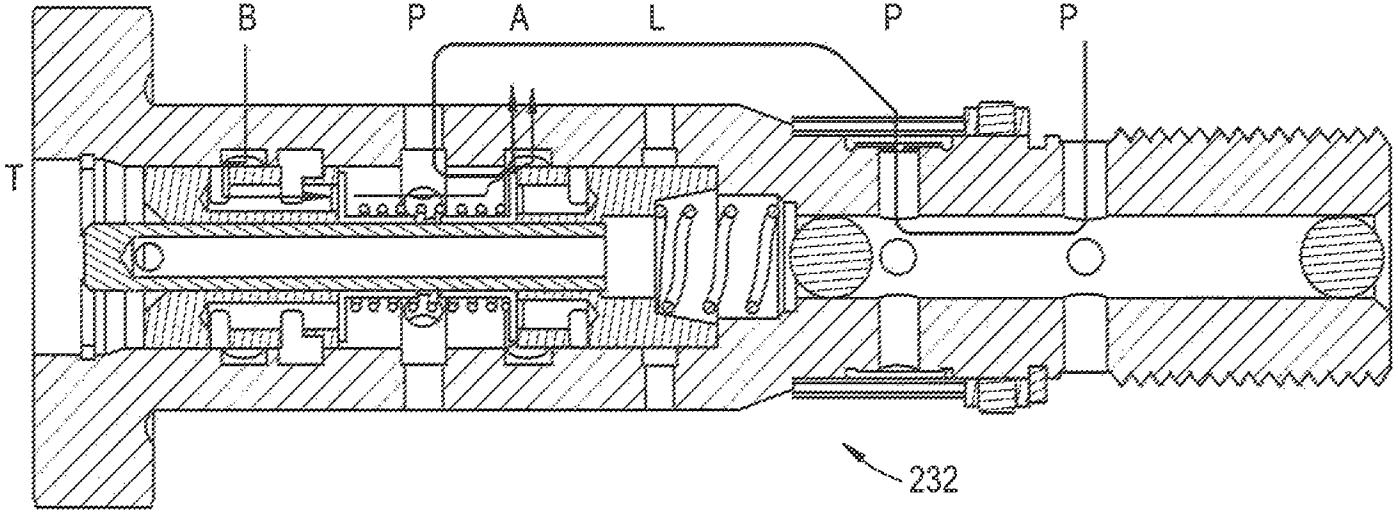

FIG. 16 shows another state of the oil control valve. This state is very much like the state shown in FIG. 14 (i.e., the lock pin 52 is unlocked and the supply valve 260 is closed), except that in this state, the oil control valve 232 allows the oil pump to supply oil to the advancement chamber (A). However, oil from the oil pump is blocked from entering the retard chamber (B) due to the oil control valve check valve 251 associated with that chamber. When the pressure of the retard chamber (B) is greater than the oil pump pressure due to cam torsionals, the oil control valve check valve 251 associated with the retard chamber (B) opens and oil from that chamber assists the oil pump and flows to the advancement chamber (A). This assistive flow is shown in FIG. 16, and provides that the rotor 210 can be more quickly located to an advanced position, despite there being little to no oil pressure.

Figure 17:
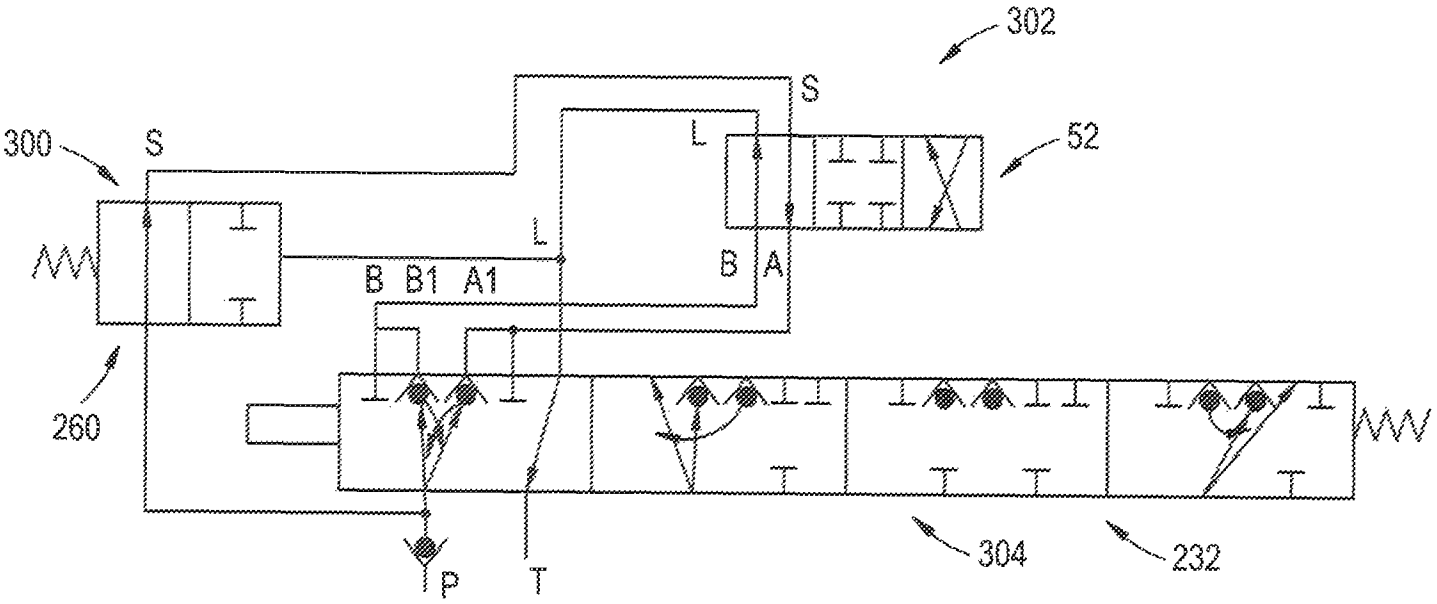
FIG. 17 is a state diagram showing the various states relating to FIGS. 11-16.

FIG. 17 provides a self-explanatory state diagram with regard to the different states of the lock pin 52, the supply valve 260, and the oil control valve 232 which have been just described, wherein section 300 of state diagram shows the states of the supply valve 260, section 302 of state diagram shows the states of the lock pin 52, and section 304 of the state diagram shows the states of the oil control valve 232. With regard to section 304, moving left-to right, the states correspond to the different states of the oil control valve 232 which are shown in FIGS. 12, 14, 15 and 16. As shown, in the left-most state of the oil control valve (FIG. 12), the lock pin 52 of the rotor 210 can be in one of three positions—advanced of the lock pin bore 50, over the lock bore 50, or retard of the lock pin bore 50. In this state, the supply valve 260 is open. However, in the other states of the oil control valve 232 (FIGS. 14-16), the supply valve 260 is closed and the lock pin 52 is unlocked.

With regard to stroke of the spool 243 relative to the bolt 241, in the first state (shown in FIG. 12), the oil control valve 232 can have a stroke of 0 mm. In the second state (shown in FIG. 14), the oil control valve 232 can have a stroke of 1.5 mm. In the third state (shown in FIG. 15), the oil control valve 232 can have a stroke of 2.6 mm. Finally, in the fourth state (shown in FIG. 16), the oil control valve 232 can have a stroke of 3.6 mm. Of course, other stroke lengths are entirely possible.

Figure 18:
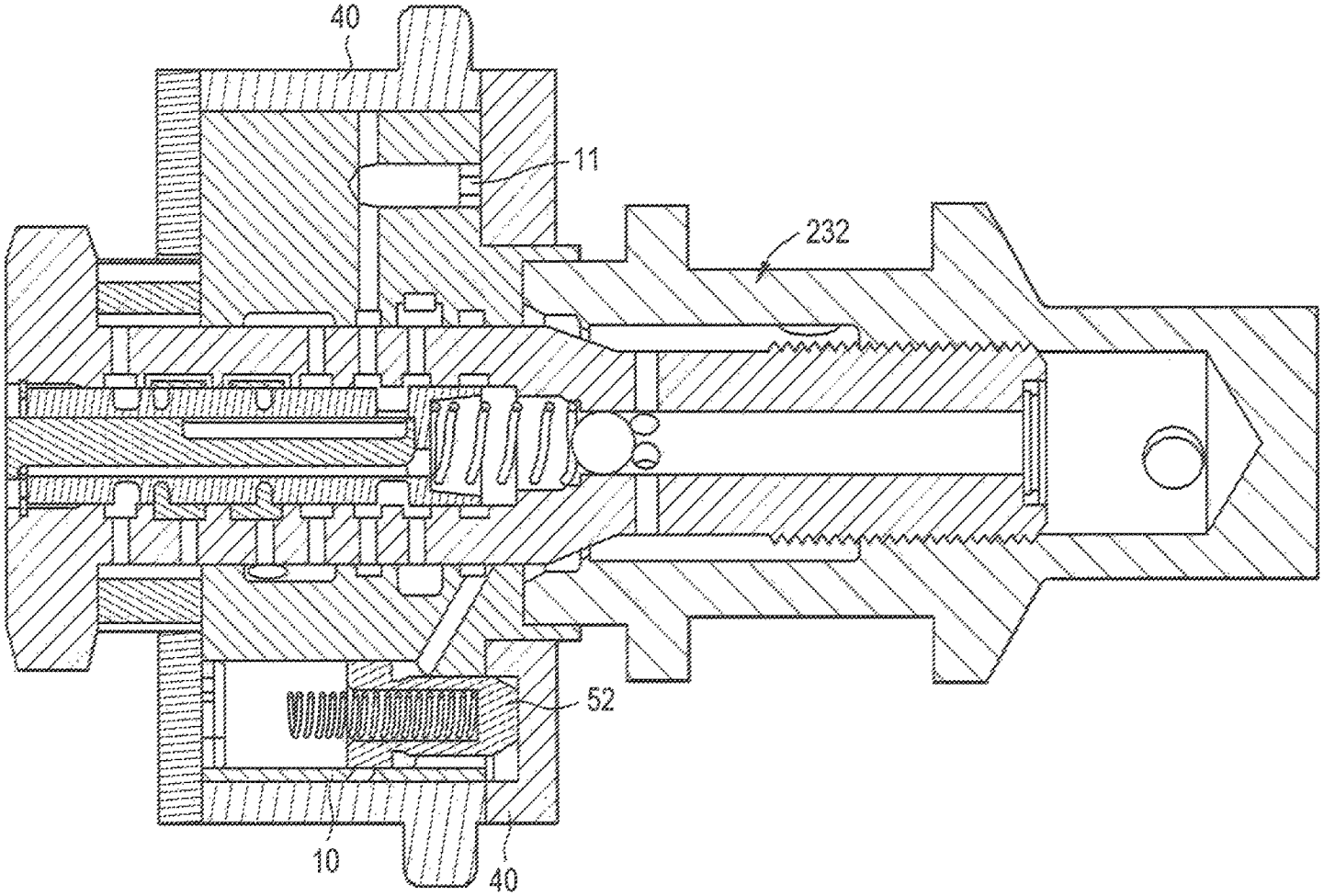
FIG. 18 is a cross-sectional view showing a supply valve, an oil control valve, and a pressure medium control valve of a valve timing control device, which is in accordance with another embodiment of the present invention.

FIG. 18 illustrates a valve timing control device which is in accordance with another embodiment of the present invention. The embodiment shown in FIG. 18 is much like the embodiment shown in FIG. 11. That which is shown in FIG. 18 is effectively another implementation of the same function as that which is shown in FIG. 11. The major difference between the two is that, instead of a supply valve 260 being used to control fluid flow to the directional supply (i.e., port 11), this function is performed by the oil control valve 232 itself.

Figure 19:
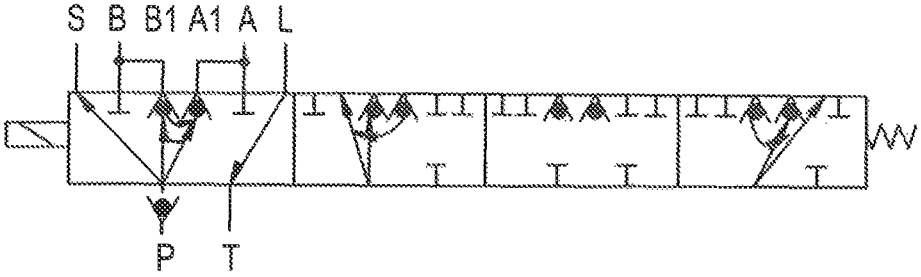
FIG. 19 is a state diagram showing the various states of the oil control valve shown in FIG. 18.

The various states of the oil control valve 232 associated with the valve timing control device shown in FIG. 18 will now be described. FIG. 19 is a state diagram which illustrates the various states of the oil control valve 232, while FIGS. 20-23 show the position of the spool relative to the bolt in each of those states. Consistent with previous embodiments described herein above, the different ports are identified in the Figures with letters (i.e., P, L, S, A and B). As shown, there is not only an A and a B, but there is also an A1 and B1. While the A port is configured to supply oil from the oil control valve 232 to the advancement chamber, the A1 port is configured so the advancement chamber can supply oil to the oil control valve 232. Likewise, while the B port is configured to supply oil from the oil control valve 232 to the retard chamber, the B1 port is configured so the retard chamber can supply oil to the oil control valve 232. This is conventional and common in many patents in the industry.

Figure 20:
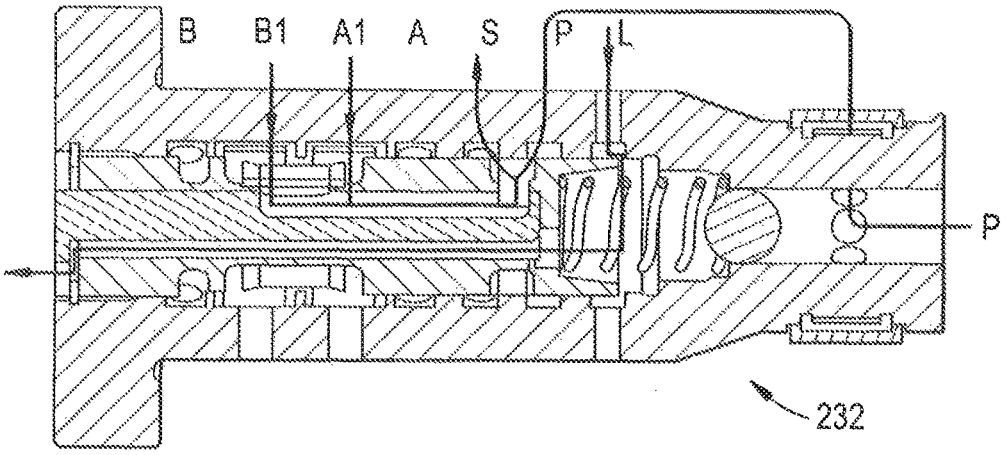
FIGS. 20-23 are similar to FIG. 18, but show the oil control valve in different states.

Moving from left to right in FIG. 19, the first state (shown in FIG. 20) is for self-centering and locking the rotor 10 relative to the stator 40 (see FIGS. 1-4 and previous description). This state occurs, for example, upon engine shut down or stall, due to the spring pushing the spool to its end-most position. In this state, the rotor 10 is automatically urged to its mid-lock position so the lock pin 52 can lock the rotor 10 relative to the stator 40. While one chamber (either the advancement or the retard chamber, depending on the position of the rotor 10) exhausts through the lock pin 52 (i.e., via centering slots 34, 54) (see FIGS. 1-4 and previous description), a directional supply of oil is provided, by the oil control valve 232, to the other chamber via the slot 11 and either slot 13 or 15 (see FIGS. 1-4 and previous description). The fluid path for the exhaustion through the lock pin 52 is shown in FIG. 20, and provides that oil flows from the lock pin 52, into the oil control valve 232, and to tank T. FIG. 20 also shows the fluid path for supplying oil to the directional supply (i.e., port 11). As shown, in this embodiment, this is performed through the oil control valve 232 by the oil pump. Additionally, oil is recirculated from the A or B chambers (via A1 and B1, respectively) to assist with the directional supply (through port 11). Due to exhausting the one chamber through the lock pin 52, and supplying the other chamber via the directional supply (i.e., port 11), the lock pin 52 eventually locates over the lock pin bore 50, and locks the rotor 10 relative to the stator 40.

Figure 21:
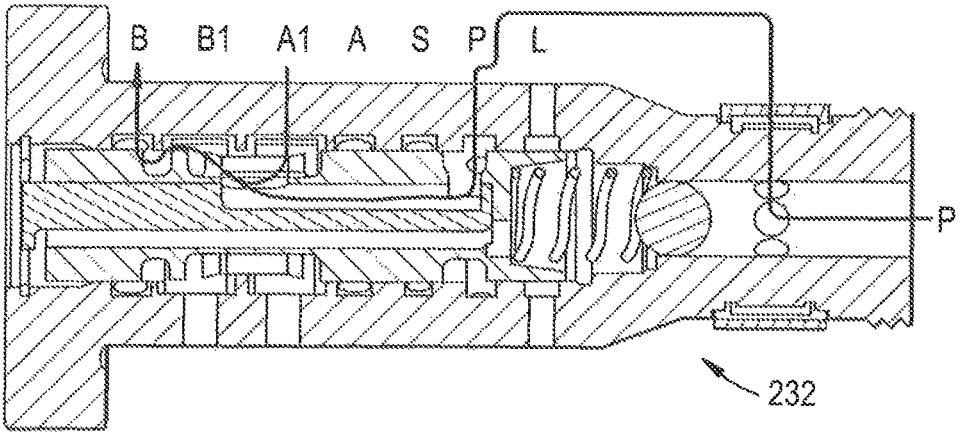
Figure 22:
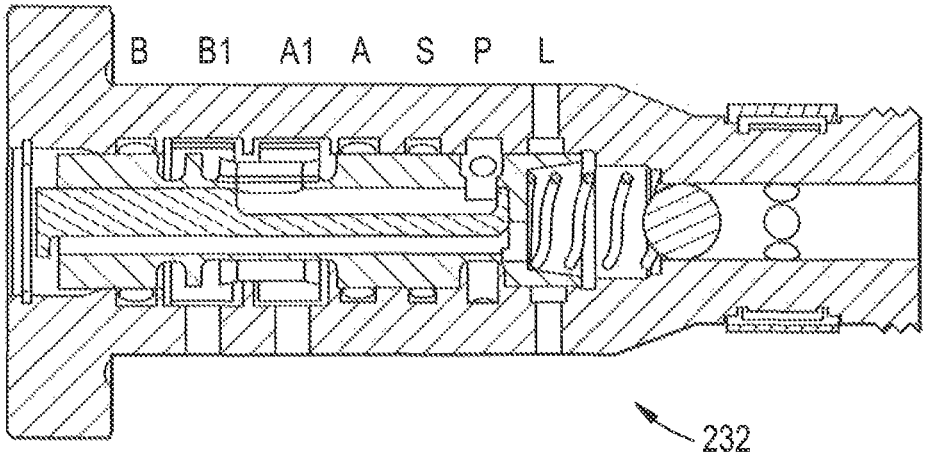

In the second state, shown in FIG. 21, the oil pump supplies oil to the oil control valve 232 and that fluid flow thereafter goes to the retard chamber (via port B). Additionally, oil from the advancement chamber recirculates to the retard chamber through the oil control valve 232 (via port A1).

The third state (shown in FIG. 22) is a "null" state, during which time oil does not flow through the oil control valve 232.

Figure 23:
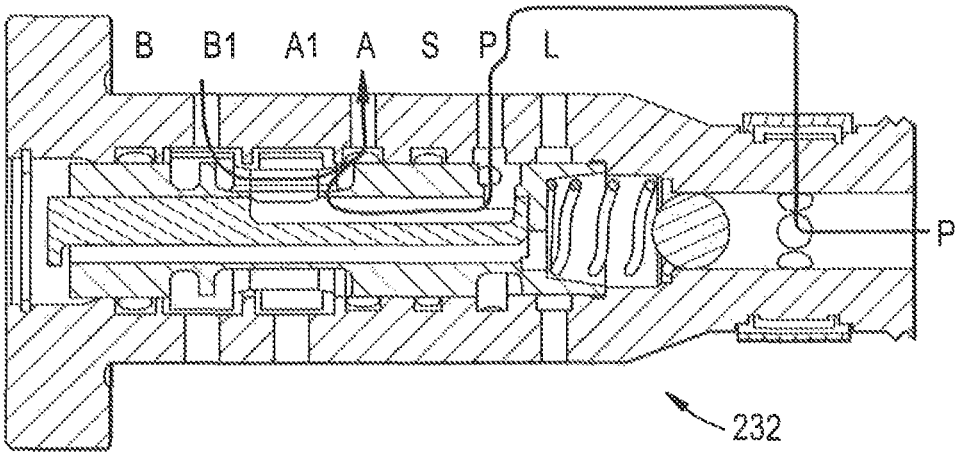

In the fourth state, shown in FIG. 23, the oil pump supplies oil to the oil control valve 232 and that fluid flow thereafter goes to the advancement chamber (via port A).

Additionally, oil from the retard chamber recirculates to the advancement chamber through the oil control valve 232 (via port B1).

During the second through the fourth states of the oil control valve 232 (FIGS. 21-23), the lock pin 52 is unlocked.

All of the embodiments disclosed herein provide a valve timing control device or cam phaser which consumes less oil, reduces the amount of time it takes to get to a mid-lock position when oil pressure and flow are limited, and does not rely on electronic control to get to that mid-lock position. Cam torque can be used to recirculate oil, in order to assist locating the cam phaser to its mid-lock position.

The described embodiments only involve exemplary configurations. A combination of the features described for different embodiments is also possible. Additional features, particularly those which have not been described, for the device parts belonging to the invention can be derived from the geometries of the device parts shown in the drawings.

While specific embodiments of the invention have been shown and described, it is envisioned that those skilled in the art may devise various modifications without departing from the spirit and scope of the present invention.

What is claimed is:

1. A valve timing control device for an internal combustion engine, said valve timing control device comprising: a rotor comprising a plurality of vanes; a stator engaged with the rotor, said stator comprising a plurality of webs, wherein advancement and retard chambers are provided between each of the webs and vanes; a lock pin which is arranged in a pressure medium control valve chamber and which locks the rotor relative to the stator at a mid-lock position; an oil control valve in fluid communication with the rotor, further comprising a centering slot on one of the plurality of vanes and a directional supply port, wherein either the advancement or the retard chamber vents oil into the oil control valve through the centering slot, during which time the oil control valve supplies oil to the other chamber through the directional supply port, thereby locating the rotor to the mid-lock position so the lock pin can lock the rotor relative to the stator, wherein the rotor comprises an outer surface and comprises at least one depression on the outer surface providing said directional supply port for the supply of oil to the advancement chamber or the retard chamber in a manner dependent on a position of the rotor relative to the stator, wherein said at least one depression is in fluid communication with the oil control valve.

2. The valve timing control device as recited in claim 1, further comprising a supply valve in the rotor, said supply valve configured to supply oil from the oil control valve to the directional supply port.

3. The valve timing control device as recited in claim 1, wherein the valve timing control device is configured to recirculate oil from either the advancement or the retard chamber to the directional supply port via the oil control valve.

4. The valve timing control device as recited in claim 3, wherein the recirculation of oil takes place through a supply valve which is disposed in the rotor.

5. The valve timing control device as recited in claim 1, wherein the directional supply port comprises at least one recess formed in an external surface of the rotor, and a fluid passageway into the rotor leading from the recess to the oil control valve.

6. The valve timing control device as recited in claim 1, wherein the directional supply port comprises at least one recess formed in an external surface of the rotor, a fluid passageway into the rotor leading from the recess to the oil control valve, and at least one recess formed in either the stator or a component connected to the stator.

7. The valve timing control device as recited in claim 1, wherein the directional supply port comprises at least one recess formed in an external surface of the rotor, a fluid passageway into the rotor leading from the recess to the oil control valve, and a pair of recesses formed in either the stator or a component connected to the stator, said pair of recesses comprising a first recess disposed in the advancement chamber, and a second recess disposed in the retard chamber.

8. The valve timing control device as recited in claim 1, wherein the lock pin is disposed in a lock pin chamber, oil from the advancement chamber flows through the centering slot, into the lock pin chamber, and out to the oil control valve, and during which time oil from oil control valve flows through the directional supply port into the retard chamber.

9. The valve timing control device as recited in claim 1, wherein the lock pin is disposed in a lock pin chamber, oil from the retard chamber flows through the centering slot, into the lock pin chamber, and out to the oil control valve, and during which time oil from oil control valve flows through the directional supply port into the advancement chamber.

10. The valve timing control device as recited in claim 1, wherein the lock pin is disposed in a lock pin chamber, oil from the advancement chamber flows through the centering slot, into the lock pin chamber, and out to the oil control valve, and during which time oil from oil control valve flows through a supply valve in the rotor, to the directional supply port, and into the retard chamber.

11. The valve timing control device as recited in claim 1, wherein the lock pin is disposed in a lock pin chamber, oil from the retard chamber flows through the centering slot, into the lock pin chamber, and out to the oil control valve, and during which time oil from oil control valve flows through a supply valve in the rotor, to the directional supply port, and into the advancement chamber.

12. The valve timing control device as recited in claim 1, wherein the lock pin is disposed in a lock pin chamber, oil from the advancement chamber flows through the centering slot, into the lock pin chamber, and out to the oil control valve, and during which time oil from oil control valve flows through the directional supply port into the retard chamber, said oil being provided to the directional supply port from both an oil pump as well as the advancement chamber through a check valve in the oil control valve.

13. The valve timing control device as recited in claim 1, wherein the lock pin is disposed in a lock pin chamber, oil from the retard chamber flows through the centering slot, into the lock pin chamber, and out to the oil control valve, and during which time oil from oil control valve flows through the directional supply port into the advancement chamber, said oil being provided to the directional supply port from both an oil pump as well as the retard chamber through a check valve in the oil control valve.

14. The valve timing control device as recited in claim 1, wherein the lock pin is disposed in a lock pin chamber, oil from the advancement chamber flows through the centering slot, into the lock pin chamber, and out to the oil control valve, and during which time oil from oil control valve flows through a supply valve disposed in the rotor through the directional supply port into the retard chamber, said oil being provided to the supply valve from both an oil pump as well as the advancement chamber through a check valve in the oil control valve.

15. The valve timing control device as recited in claim 1, wherein the lock pin is disposed in a lock pin chamber, oil from the retard chamber flows through the centering slot, into the lock pin chamber, and out to the oil control valve, and during which time oil from oil control valve flows through a supply valve disposed in the rotor through the directional supply port into the advancement chamber, said oil being provided to the supply valve from both an oil pump as well as the retard chamber through a check valve in the oil control valve.

* * * * *